US007971865B2

(12) United States Patent
Kern et al.

(10) Patent No.: US 7,971,865 B2
(45) Date of Patent: Jul. 5, 2011

(54) INSERTING APPARATUS FOR DISCRETE OBJECTS INTO ENVELOPES AND RELATED METHODS

(75) Inventors: Peter Kern, St. Peter Port (GB); Reinhard Buri, Donaueschingen/Pfohren (DE)

(73) Assignee: Kern International, Inc.

( * ) Notice: Subject to any disclaimer, the term of this patent is extended or adjusted under 35 U.S.C. 154(b) by 265 days.

(21) Appl. No.: 12/231,753

(22) Filed: Sep. 5, 2008

(65) Prior Publication Data

US 2010/0059918 A1 Mar. 11, 2010

(51) Int. Cl.
*B65H 1/02* (2006.01)

(52) U.S. Cl. ..... 270/58.06; 53/284.3; 53/381.6; 271/94; 271/155

(58) Field of Classification Search ..... 270/58.06; 271/94, 154, 152, 153, 155; 53/284.3, 381.6
See application file for complete search history.

(56) References Cited

U.S. PATENT DOCUMENTS

| | | | | |
|---|---|---|---|---|
| 24,459 | A | 6/1859 | Hall | |
| 2,915,863 | A | 12/1959 | Kummer | |
| 3,253,384 | A | 5/1966 | Huck et al. | |
| 3,568,401 | A | 3/1971 | Bonsch | |
| 3,593,486 | A | 7/1971 | Helm | |
| 3,753,836 | A | 8/1973 | Buckholz | |
| 3,872,649 | A | 3/1975 | Wimmer | |
| 4,132,402 | A | 1/1979 | Morrison et al. | |
| 4,360,356 | A | 11/1982 | Hall | |
| 4,473,430 | A | 9/1984 | Voltmer et al. | |
| 4,605,457 | A | 8/1986 | Guy | |
| 4,649,691 | A | 3/1987 | Buckholz | |
| 4,884,793 | A | 12/1989 | Hurst | |
| 5,088,718 | A | 2/1992 | Stepan et al. | |
| 5,191,751 | A | 3/1993 | Marzullo et al. | |
| 5,244,199 | A | 9/1993 | Wood | |
| 5,251,425 | A | 10/1993 | Kern | |
| 5,327,705 | A | 7/1994 | DeFigueiredo | |
| 5,487,254 | A | 1/1996 | Dronsfield | |
| 5,675,959 | A | 10/1997 | Hamma et al. | |
| 5,777,658 | A * | 7/1998 | Kerr et al. | 347/215 |
| 5,957,448 | A | 9/1999 | Frank et al. | |
| 5,971,391 | A | 10/1999 | Salomon et al. | |
| 5,992,132 | A | 11/1999 | Auerbach | |
| 6,352,257 | B1 | 3/2002 | Todaro et al. | |
| 6,561,502 | B1 | 5/2003 | Flickner | |
| 7,077,397 | B2 | 7/2006 | Stevens | |
| 7,427,063 | B2 | 9/2008 | Fairweather et al. | |

(Continued)

FOREIGN PATENT DOCUMENTS

| | | |
|---|---|---|
| CA | 2 373 321 | 11/2000 |

(Continued)

OTHER PUBLICATIONS

Third Office Action issued in related Chinese Patent Application No. 200380109842.0; Mar. 27, 2009; 8 pages; Chinese Patent Office.

(Continued)

*Primary Examiner* — Patrick Mackey
(74) *Attorney, Agent, or Firm* — Wood, Herron & Evans, LLP

(57) ABSTRACT

An apparatus for inserting a paper or film object or a stack of such objects into an envelope. A feeding apparatus moves the object toward an insertion station and a vacuum drum has a surface adapted to engage and move the envelope toward the insertion station. A ramp element is coupled to the vacuum drum and is adapted to support a leading portion of the envelope as the envelope moves with the vacuum drum.

27 Claims, 10 Drawing Sheets

U.S. PATENT DOCUMENTS

| | | | |
|---|---|---|---|
| 2003/0025266 | A1 | 2/2003 | Stevens |
| 2006/0156876 | A1 | 7/2006 | Sussmeier et al. |
| 2006/0249895 | A1 | 11/2006 | Kern |
| 2007/0040316 | A1 | 2/2007 | Kern |
| 2008/0087147 | A1 | 4/2008 | Sussmeier et al. |
| 2008/0106022 | A1 | 5/2008 | Sussmeier et al. |

FOREIGN PATENT DOCUMENTS

| | | |
|---|---|---|
| DE | 37 00 112 | 7/1988 |
| DE | 298 13 546 | 11/1998 |
| EP | 0 253 995 | 1/1988 |
| EP | 0 504 114 | 9/1992 |
| EP | 0 876 908 | 11/1998 |
| EP | 1 108 563 | 6/2001 |
| EP | 1 297 970 | 4/2003 |
| EP | 1 622 778 | 11/2004 |
| EP | 1 683 651 | 7/2006 |
| WO | 2004/098905 | 11/2004 |

OTHER PUBLICATIONS

Irina Becker; Invitation to Pay Additional Fees in related PCT patent application No. PCT/US2009/030538; Apr. 1, 2009; 5 pages; European Patent Office.

Irina Becker; Invitation to Pay Additional Fees in related PCT patent application No. PCT/US2009/030549; Apr. 8, 2009; 5 pages; European Patent Office.

Cormac Kelliher; International Search Report and Written Opinion; Aug. 6, 2009; 15 pages; European Patent Office.

Ole Henningsen; International Search Report and Written Opinion issued in related International Patent Application No. PCT/US2009/030536; Jun. 3, 2009; 12 pages; European Patent Office.

Ole Henningsen; International Search Report and Written Opinion issued in related International Patent Application No. PCT/US2009/030559; Jun. 2, 2009; 11 pages; European Patent Office.

Kaitlin S. Joerger; Office Action issued in Applicant's related U.S. Appl. No. 12/231,755; Jul. 23, 2009; 14 pages; U.S. Patent and Trademark Office.

Kaitlin S. Joerger; Notice of Allowance issued in Applicant's related U.S. Appl. No. 12/231,755; Feb. 12, 2010; 5 pages; U.S. Patent and Trademark Office.

European Patent Office, Notification of Transmittal of the International Preliminary Report on Patentability in PCT/US2009/030538, Dec. 9, 2010, 6 pgs.

* cited by examiner

INSERTING APPARATUS FOR DISCRETE OBJECTS INTO ENVELOPES AND RELATED METHODS

CROSS-REFERENCE

This application is generally related to the following U.S. patent application Ser. No. 12/231,739, entitled "Apparatus for Guiding and Cutting Web Products and Related Methods;" Ser. No. 12/231,755, now issued as U.S. Pat. No. 7,717,418, entitled "Envelope Conveying and Positioning Apparatus and Related Methods;" Ser. No. 12,231,754, entitled "Transporting Apparatus for Discrete Sheets into Envelopes and Related Methods;" Ser. No. 12/231,730, entitled "Conveying Apparatus for Envelopes and Related Methods;" and Ser. No. 12,231,749, entitled "Transporting Apparatus for Web Products and Related Methods", all being filed on even date herewith and expressly incorporated herein by reference in their entirety.

TECHNICAL FIELD

The present invention generally relates to converting equipment and, more particularly, to apparatus for converting paper into sheets, collating and automatic envelope stuffing operations.

BACKGROUND

Converting equipment is known for automatically stuffing envelopes. Such equipment may include components for feeding a pre-printed web of paper, for cutting such web into one or more discrete sheets for collating sheets, and for feeding such discrete sheet collations into envelopes. Such equipment may further include components to convey the stuffed envelopes to a specified location. The industry has long known devices which accomplish these and other functions. However, improvements are needed where high volumes of paper piece count and high speeds are required without sacrificing reliability accuracy and quality of end product.

More particularly, a large roll of paper is typically printed in discrete areas with piece specific information. That is, the initial roll of paper comprises vast numbers of discrete areas of already-printed indicia-specific information with each discrete area defining what is to eventually comprise a single page or sheet of indicia specific information. To complicate the process, a variable number of sheets with related indicia must be placed into the envelopes so that the content of one envelope varies from the content of another by sheet count and, of course, by the specific indicia on the included sheets. As one example, financial reports of multiple customers or account specifics may require a varied number of customer or account specific sheets to be cut, respectively collated, stuffed and discharged for delivery. Thus, the contents of each envelope include either a single sheet or a "collation" of from two to many sheets, each "collation" being specific to a mailing to an addressee.

In such an exemplary operation, a financial institution might send billing or invoice information to each of its customers. The billing information or "indicia" for one customer may require anywhere from one final sheet to a number of sheets which must be collated, then placed in that customer's envelope. While all this information can be printed in sheet size discrete areas, on a single roll, these areas must be well defined, cut, merged or collated into sheets for the same addressee or destination, placed into envelopes, treated and discharged. Thus, a system for conducting this process has in the past included certain typical components, such as a paper roll stand, drive, sheet cutter, merge unit, accumulate or collate unit, folder, envelope feeder, envelope inserter, and finishing and discharge units. Electronic controls are used to operate the system to correlate the functions so correct sheets are collated and placed in correct destination envelopes.

In such multi-component systems, the pass-through rate from paper roll to finished envelope is dependent on the speed of each component, and overall production speed is a function of the slowest or weakest link component. Overall reliability is similarly limited. Moreover, the mean down time from any malfunction or failure to repair is limited by the most repair-prone, most maintenance consumptive component. Such systems are capital intensive, requiring significant floor plan or footprint, and require significant labor, materials and maintenance capabilities and facilities.

In such systems, inserting apparatus are known for inserting a single discrete sheet of material or a stack of such sheets into envelopes. Some conventional systems of this type use vacuum drums. In systems of this type, high levels of maintenance are required for components such as valves that are continuously being energized and deenergized. Likewise, in systems of this type, the deenergizing of vacuum components during an inserting operation has been observed to ramp down over a period of time rather than instantaneously, which results in unintended forces being applied, for example, onto envelopes. This, in turn, results in poor control of the inserting operation.

Accordingly, it is desirable to provide improved inserting apparatus for the insertion of discrete paper or film objects into envelopes in a high speed handling machine. It is also desirable to provide a converting apparatus and related methods that address inherent problems observed with conventional converting apparatus.

SUMMARY

To these ends, in one embodiment of the invention, an envelope is fed between two rollers toward an insertion station, an insert inserted there and the envelope thereafter fed between one of said rollers and another roller away from the insertion station. Once the envelope is fed between the two rollers toward the insertion station, its trail end clears the two rollers and the motion of the envelope is reversed. The motion of the insert into the envelope pushes the tail end of the envelope back toward the one roller but on an opposite side of its axis where continued motion of that roller in the same angular direction drives the envelope away from the insertion station.

In other words, the rollers engaging and moving the envelope first toward then away from the insertion station continue to rotate continuously in the same direction, while at least a common roller engaging the envelope serves to drive the envelope toward the insertion station and then, when the envelope clears that roller, to drive said envelope after insertion in another direction away from the insertion station. This is accomplished by the tail edge or end of the envelope first clearing the roller on one side of its axis of rotation, then being driven by the motion of the insert back against the same roller on another side of its axis.

It will be appreciated that this invention provides apparatus and methods which positively control both the separate work pieces or inserts as they are fed to an insertion station, and of the filled envelope as it departs the insertion station, thus enhancing reliability of the apparatus. More particularly, an apparatus for inserting an object such as an insert into an envelope includes a vacuum drum that engages and moves an envelope and a ramp element having a surface generally tangential to the vacuum drum for disengaging the envelope from the vacuum drum. More particularly, in one embodiment, an apparatus is provided for inserting a paper or film object or a stack of such objects into an envelope. The apparatus includes a feeding apparatus for moving the object toward the envelope and a vacuum drum that has a surface adapted to engage and move the envelope toward the object. A ramp element is operatively oriented with respect to the vacuum drum and includes a generally flat surface that is tangential to the vacuum drum and adapted to support a leading portion of the envelope as the envelope moves with the vacuum drum.

The vacuum drum may be servo-controlled and include a plurality of holes defining a surface for engagement of the envelope, and a vacuum source in fluid communication with the plurality of holes for selectively applying negative pressure through one or more of the plurality of holes. The vacuum drum may include a vacuum source that is continuously generating negative pressure or suction at the surface of the vacuum drum. The ramp element may be stationary relative to the vacuum drum. A first rotating element may be rotatable in a first rotating direction for moving the envelope in a first travel direction toward the object. Rotation of the first rotating element in the first rotating direction may then move the envelope in a second travel direction opposite the first travel direction. A second rotatable element may cooperate with the first rotating element to move the envelope in the second travel direction. The feeding apparatus may include a plurality of fingers, with each of the fingers cooperating with the first rotating element to move the envelope in the second travel direction. Each of the fingers may move the object against a trailing end of the envelope to thereby move the envelope in the second travel direction. Rotation of the vacuum drum relative to the ramp element may be configured to lift the envelope away from the surface of the vacuum drum.

In another embodiment, an apparatus is provided for inserting a paper or film object or a stack of such objects into an envelope. The apparatus includes a feeding apparatus for moving the object toward the envelope and a vacuum drum that has a surface adapted to engage and move the envelope toward the object and a vacuum source continuously generating a negative pressure at the surface. A ramp element is coupled to the vacuum drum and is stationary relative to the vacuum drum, with the ramp element including a generally flat surface that is tangential to the vacuum drum and adapted to support the envelope as the envelope moves with the vacuum drum.

In yet another embodiment, an automatic envelope stuffing apparatus is provided. The apparatus includes a first end associated with feeding of a roll of paper and a processing apparatus for converting the roll of paper into discrete sheets. The apparatus also includes an apparatus for inserting the discrete sheets of paper into the envelopes and having a feeding apparatus for inserting the discrete sheets of paper toward the envelopes, a vacuum drum having a surface adapted to engage and move the envelopes toward the discrete sheets, and a ramp element. The ramp element is operatively oriented with respect to the vacuum drum and includes a generally flat surface tangential to the vacuum drum and adapted to support the envelopes as the envelopes move with the vacuum drum.

In another embodiment, a method is provided for inserting a paper or film object or a stack of such objects into an envelope. The method includes moving the object toward the envelope, applying negative pressure against the envelope to engage the envelope against a rotating surface, and moving the rotating surface to move the envelope toward the object. A leading portion of the envelope is supported with a relatively stationary surface as the envelope moves with the rotating surface.

The method may include lifting the leading portion of the envelope away from the rotating surface. Alternatively or additionally, the method may include rotating a first rotating element in a first rotating direction to move the envelope in a first travel direction toward the object. The method may include rotating the first rotating element in the first rotating direction to move the envelope in a second travel direction that is opposite the first travel direction. The method may include continuously applying the negative pressure against the rotating surface. The method may include electrically controlling movement of the rotating surface relative to a vacuum source for selectively generating the negative pressure on selected portions of the rotating surface. The method may include moving the envelope in a plane that is generally tangential to the rotating surface.

Such apparatus and methods are particularly useful in a paper converting and envelope stuffing system contemplating improved paper converting and sheet inserting apparatus and methods, modular based, and having improved paper handling apparatus, servo driven components, improved sensor density and improved control concepts controlling the system operation. One or more of the embodiments of the invention contemplate the provision of an improved transporting apparatus which can be used as a module of a modular paper converting and sheet insertion system where human capital, required space, required equipment, maintenance, labor and materials and facilities therefore are reduced compared to conventional systems of similar throughput.

More specifically, such improved apparatus and methods contemplate a plurality of functional modules providing the following functions in a series of modules of like or dissimilar modules where a specific module is multi-functional. The functions comprise:

printed paper roll handling/unwinding;
paper slitting and cutting;
sheet collation and accumulation;
sheet folding;
transportation for interfacing with inserts;
envelope feeding;
collation interfacing and insertion; and
envelope treating and discharge.

More particularly, one or more aspects of the invention may contemplate, without limitation, new and unique apparatus and methods for:

(a) guiding a web of the paper or film containing the printed indicia into a cutter apparatus;
(b) processing the web through slitting and transverse-cutting operation;
(c) transporting and merging discrete pieces of the insert;
(d) accumulating predefined stacks of discrete pieces of the insert;
(e) guiding and transporting a stack of discrete pieces of the insert toward an envelope-filling station;
(f) transporting individual envelopes toward the envelope-filling station;
(g) creating and processing a stack of the envelopes prior to the envelope-filling process; and
(h) processing an individual envelope from the stack of envelopes and through the envelope-filling station.

While the combination of the particular functions in the particular modules are unique combinations, the invention of this application lies primarily in the paper transporting apparatus and methods described herein.

DETAILED DESCRIPTION

Figure 1:
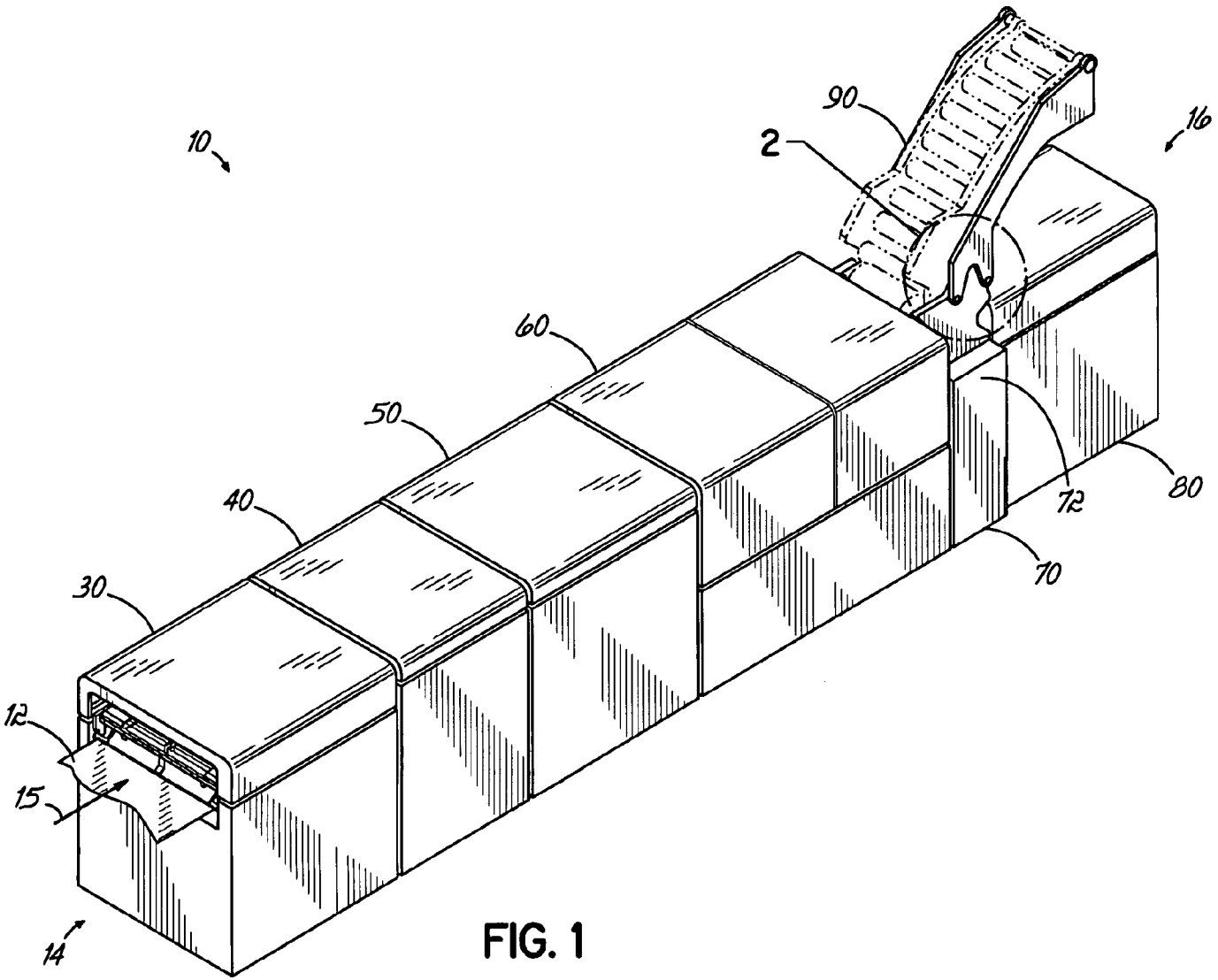
FIG. 1 is a perspective view illustrating a portion of a converter for stuffing envelopes with selected paper or film objects.

Referring to the figures and, more particularly to FIG. 1, a portion of an exemplary converter 10 is illustrated for processing a web 12 of paper or film. Although not shown, the web 12 processed by the converter 10 originates, for example, from a roll (not shown) of material containing such web. The roll is generally associated with a first end 14 of the converter 10 and is unwound in ways known in the art, for example, by driving a spindle receiving a core of the roll or by contacting a surface of the roll with a belt or similar device. Typically, the web 12 is pre-printed with indicia in discrete areas.

The web 12 thus travels in a machine direction, generally indicated by arrow 15, through several modules that make up the converter 10. In the exemplary embodiment of FIG. 1, converter 10 cuts the web material into discrete sheets (corresponding to the "areas") of material ("inserts") and feeds them into envelopes fed generally from an opposite end 16 of converter 10. Converter 10 may further convey the envelopes containing the inserts away from the shown portion of the converter 10 for subsequent processing or disposition. The exemplary converter 10 includes, as noted above, several modules for effecting different steps in the processing of the web and the inserts resulting therefrom, as well as processing of the envelopes. Those of ordinary skill in the art will readily appreciate that converter 10 may include other modules in addition or instead of those shown herein.

A first of the shown modules, for example, is a cutting module 30 relatively proximate first end 14 of the converter 10 and which cuts the web 12 into discrete objects such as inserts (not shown) for subsequent processing. A conveying module 40 controls and transports the discrete inserts received from the cutting module and feeds them into a folding and buffering module 50. Module 50 may, if necessary, form stacks of the discrete inserts for subsequent processing, for example, if the intended production requires stuffing the envelopes with inserts defined by more than one discrete sheet. Module 50 folds the discrete inserts, if required by the intended production, along a longitudinal axis of the discrete inserts disposed generally along the machine direction. Moreover, module 50 accumulates, collates or buffers sets of the discrete sheets into individually handled stacks, if the particular production so requires.

With continued reference to FIG. 1, an uptake module 60 takes the inserts from folding and buffering module 50 and cooperates with components of a stuffing module 70 to transport the inserts and feed them into envelopes. The envelopes, in turn, are handled and fed toward the stuffing module 70 by an envelope conveyor 80. A conveying assembly 90 is operatively coupled to the stuffing module 70 and the envelope conveyor 80 for conveying the stuffed or filled envelopes away from the shown portion of converter 10 for subsequent processing or disposition.

Figure 2:
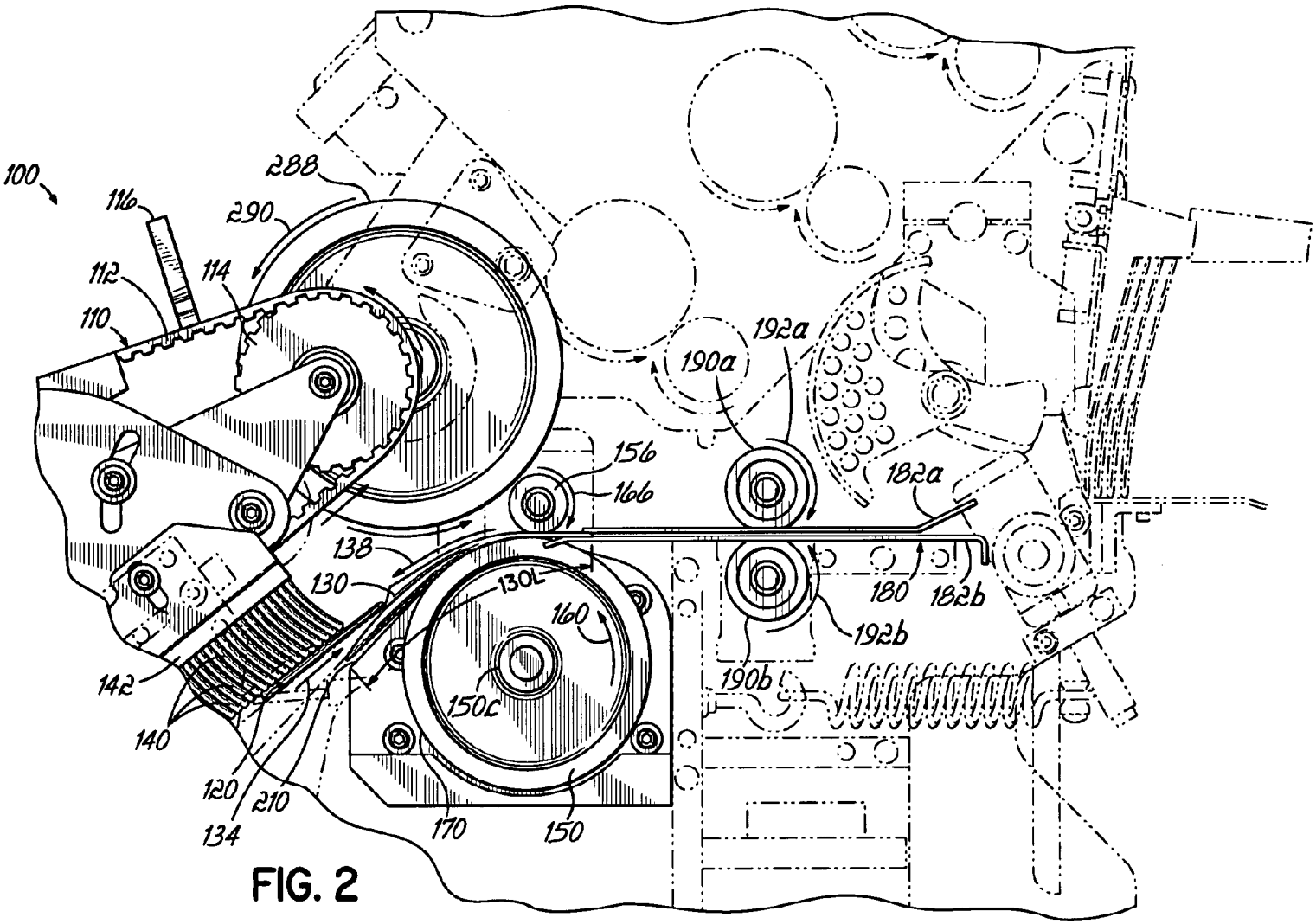
FIG. 2 is an elevation view of a portion of a stuffing or inserting apparatus of the converter of FIG. 1, more specifically associated with the encircled area 2 of FIG. 1.

With reference to FIG. 2, an exemplary stuffing module 70 is illustrated in greater detail. Module 70 includes a frame 72 that supports an inserting system or apparatus 100 that feeds the discrete sheets or inserts toward the envelopes, feeds the envelopes toward the discrete sheets, inserts the discrete sheets into the envelopes, and moves the stuffed envelopes toward the conveying assembly 90 (FIG. 1). To these ends, apparatus 100 includes a feeding apparatus 110 in the form of a belt assembly 112 rotatable in a closed loop (only partially shown) and driven by a toothed wheel 114. A plurality of fingers 116 extend from the belt assembly 112 and are spaced along the length of the belt assembly 112. Fingers 116 engage the trailing edges of inserts 120 to thereby move them toward envelopes 130 in the general direction of arrow 134 while the envelopes 130 are moved toward the inserts 120 in the general direction of arrow 138. A plurality of deflectable elements in the form, in this exemplary embodiment, of bristles 140, form part of support elements 142 of the feeding apparatus 110. The bristles 140 engage the inserts 120 as they move toward the envelopes 130.

As noted above, the envelopes 130 first move in the general direction of arrow 138 toward the inserts 120. This movement of the envelopes 130 is provided by cooperation between a rotating vacuum drum 150 and a rotating main roller 156 that nip each envelope 130. Vacuum drum 150 and main roller 156 are supported from a frame 158 (shown in phantom in FIG. 3) of stuffing module 70. When the vacuum drum 150 and main roller 156 rotate in directions opposite one another, the engagement with an envelope 130 disposed between them results in the envelope 130 moving toward the inserts 120 at an insertion or stuffing station. More specifically, the vacuum drum 150 rotates in the direction indicated by arrow 160 (counterclockwise) while the main roller 156 rotates in the direction indicated by arrow 166 (clockwise). A distance between the vacuum drum 150 and main roller 156 is suitably chosen to effectively nip an envelope 130 therebetween. In this regard, therefore, this distance is chosen based on factors including but not limited to a predetermined thickness of the envelopes 130. Although not shown, one or both of the vacuum drum 150 and main roller 156 may be adjustable to thereby permit adjustment of the distance between them.

The materials for vacuum drum 150 and main roller 156 are suitably chosen to permit engagement and movement of the envelopes in the direction of arrow 138. For example, and without limitation, at least an outer surface if not a substantial portion of the main roller 156 may be made of rubber, urethane or other materials providing a predetermined level of friction against the envelopes 130. Likewise, at least a surface 170 of vacuum drum 150 is made out of a metal such as stainless steel, which may further be coated with a release-type surface or texture to prevent, for example, build-up of adhesive or other materials on the surface 170.

Vacuum drum 150 and main roller 156 receive each envelope from guides 180 (only one shown in the view of FIG. 2) defined by oppositely disposed rails 182*a*, 182*b* that guide the envelopes 130. More specifically, rails 182*a*, 182*b* define a space between them that receives the lateral portions 130*a* (FIG. 4) of each envelope 130. Two pairs (only one shown) of driven secondary rollers 190*a*, 190*b* are positioned between the guides 180 to facilitate movement of the envelopes guided by guides 180. More specifically, rollers 190*a*, 190*b* rotate in directions opposite one another (arrows 192*a*, 192*b*) and are positioned to nip a center portion of the envelopes 130 to thereby move the envelopes 130 toward the inserts 120.

Figure 3:
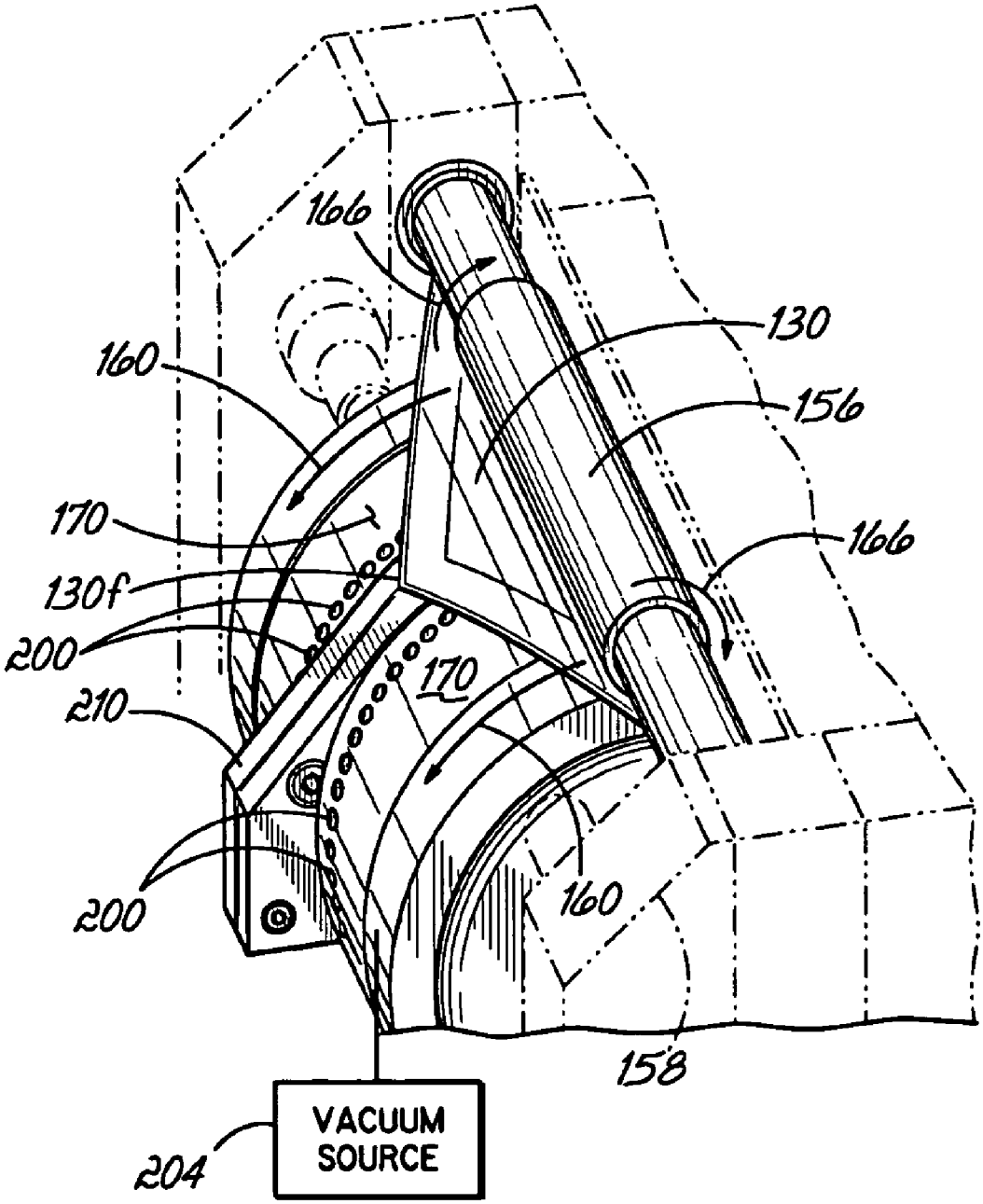
FIG. 3 is a perspective view of a vacuum drum and main roller of the inserting apparatus of FIG. 2.

With continued reference to FIG. 2 and with additional reference to FIG. 3, vacuum drum 150 includes a plurality of holes 200 on the surface 170 and configured to permit movement of the envelopes 130 with rotation of vacuum drum 150. More particularly, holes 200 are in fluid communication with a schematically-depicted vacuum source 204 to generate a negative pressure at the surface 170 of the vacuum drum 150. The negative pressure engages the envelopes 130 thereby retaining the envelopes 130 and preventing or minimizing movement of the envelopes 130 relative to vacuum drum 150 as vacuum drum 150 rotates.

In this exemplary embodiment, the vacuum source 204 is continuously operating i.e., it is continuously in an "ON" condition. Moreover, the vacuum drum 150 is electrically controlled, for example, servo-controlled to facilitate the selective application of negative pressure against selected groups of the holes 200 and thus, selected portions of the surface 170 of vacuum drum 150. Selection of the holes 200 to which the vacuum source 204 directs the negative pressure is chosen, for example, based on a pitch or length 130L of the envelopes 130. In this regard, the vacuum drum 150 can be rotated relative to the vacuum source 204 to align vacuum source 204 with the desired group of holes 200 that enable engagement, by rotating surface 170, of a particular type of envelope 130 and/or a selected portion of the envelope 130. For example, vacuum drum 150 can be rotated relative to the vacuum source 204 such that negative pressure is not applied to the trailing portion of the envelope 130, which may facilitate release of the envelope 130 from vacuum source 204.

Vacuum drum 150 includes two lateral portions 150*a*, 150*b* having similar structures and rotatable from a common central core 150*c*. The holes 200, in this regard, are positioned on both of the lateral portions 150*a*, 150*b* to thereby permit even engagement of the envelopes 130. Accordingly, the exemplary arrangement of holes 200 in this embodiment prevents or at least minimizes skewing of the envelopes 130 as they travel with rotation of the vacuum drum 150.

With continued reference to FIGS. 2-3, a ramp element 210 is coupled to the vacuum drum 150 to permit release of the envelopes 130 from the surface 170 of vacuum drum 150. More specifically, ramp element 210 is stationary relative to the vacuum drum 150 and is positioned between the two lateral portions 150*a*, 150*b* of vacuum drum 150. Ramp element 210 is in the form of a solid block having a surface that is generally tangential to the surface 170 of vacuum drum 150. In operation, as an envelope 130 moves with rotation of vacuum drum 150 (arrows 160), a leading portion 130*f* of the envelope 130 rides over the ramp element 210 to thereby disengage the leading portion 130*f* away from the surface 170 of vacuum drum 150.

Those of ordinary skill in the art will appreciate that, alternatively, ramp element 210 could take other forms, so long as it is arranged to be generally tangential to the surface 170 of vacuum drum 150. Likewise, it is contemplated that ramp element 210 could be alternatively a moving element, rather than completely stationary, so long as it is stationary relative to the vacuum drum 150. For example, and without limitation, an alternative embodiment may include a ramp element that moves in the same or opposite direction relative to the vacuum drum 150 so as to define a stationary ramp element relative to vacuum drum 150.

Figure 4A:
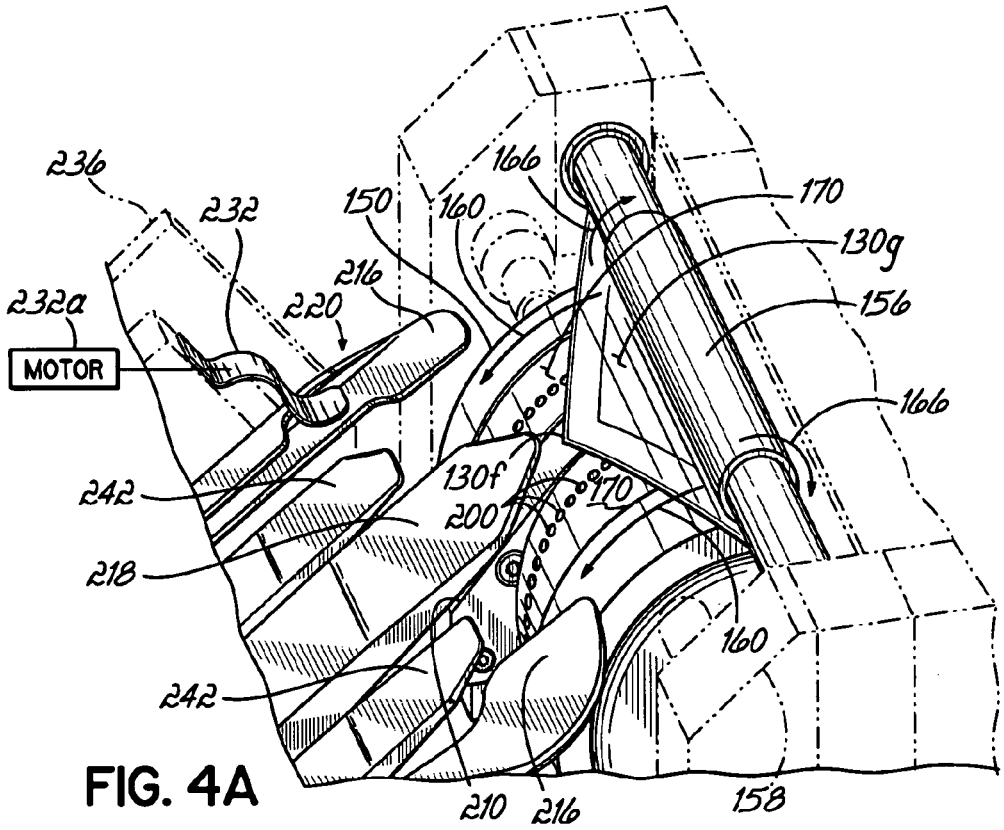
FIG. 4A is a view similar to FIG. 3, additionally showing a sheet inserting assembly of the inserting apparatus of FIG. 2.

With reference to FIGS. 4A-4D, an exemplary inserting operation is illustrated. FIG. 4A depicts an envelope 130 moving with rotation (arrows 160) of the vacuum drum 150. Holes 200 are in engagement with most of the length of envelope 130. The orientation of envelope 130 is such that the leading portion 130*f* thereof is a flap of the envelope. Moreover, the orientation is such that the substrate of paper 130*g* defining the flap of the envelope 130 faces the surface 170 of vacuum drum 150, while an opposite substrate 130*h* (FIG. 4B) faces the main roller 156. Those of ordinary skill will appreciate that this orientation is merely exemplary and other alternative orientations may be substituted instead.

FIG. 4A also shows the leading portion 130*f* of envelope 130 beginning to engage ramp element 210. Envelope 130 is moreover shown moving toward a pair of outer extension elements 216 and a central extension element 218 of a transporting apparatus 220. Transporting apparatus 220 conveys the inserts 120 (FIG. 4B) toward the envelope 130 and includes the feeding apparatus 110 and support elements 142 (FIG. 2) described above. In this exemplary embodiment, moreover, transporting apparatus 220 includes a pair of clips 232 (only one shown) extending from a frame 236 (shown in phantom) of apparatus 220. Transporting apparatus 220, in this embodiment, also includes a pair of guide elements 242 that facilitate guidance of the inserts 120 into an envelope 130. The positions of clips 232 are controlled by schematically-depicted motors 232*a* (only one shown) operatively coupled to the clips 232 through jack screws (not shown) and which permit automatic adjustment of the positions of clips 232 in response to the length 130L of the envelopes 130. More specifically, motors 232*a* facilitate adjusting a position of clips 232 toward and away from main roller 156. Motors 232*a* may, for example, be stepper motors such as model HRA08C available from Sick Stegmann GmbH, a member of the Sick AG group of Waldkirch, Germany.

Figure 4B:
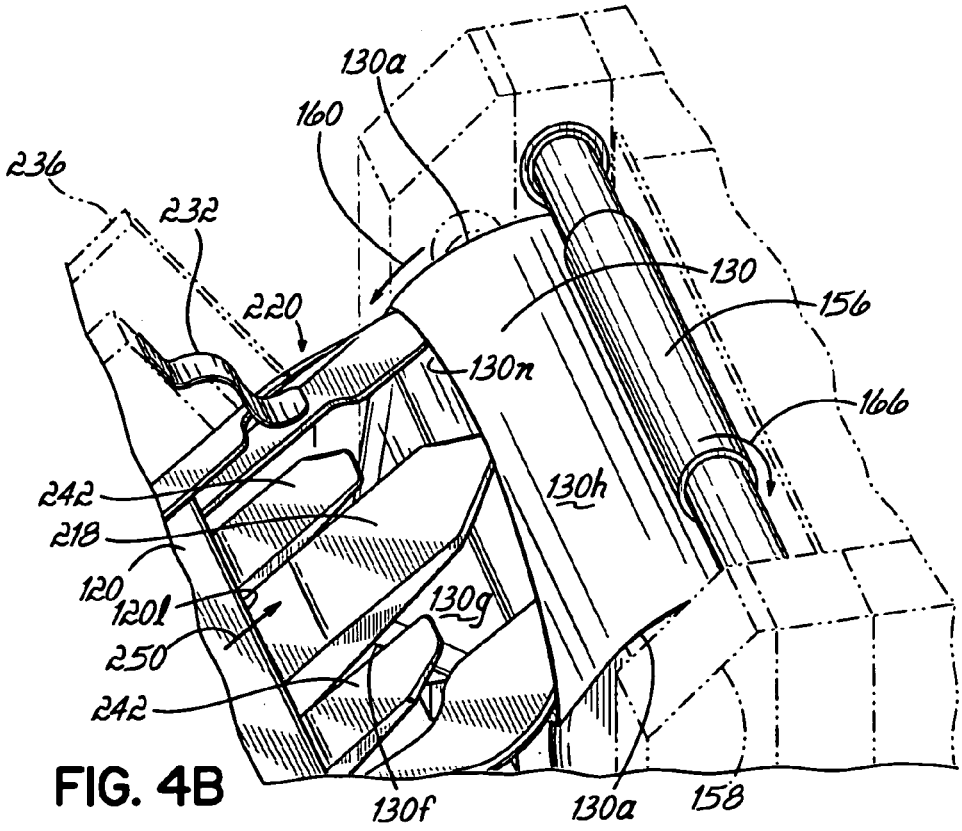
FIG. 4B is a view similar to FIG. 4A showing an envelope in a different position relative to that shown in FIG. 4A.

With particular reference to FIG. 4B, the envelope 130 is shown having partially engaged the extension elements 216, 218 in such a way that extension elements 216, 218 extend into an interior portion 130*n* of the envelope 130. At this stage of the inserting process, and relative to the stage shown in FIG. 4A, a greater portion of the length 130L (FIG. 2) of the envelope 130 has engaged the ramp element 210 and is accordingly disengaged from surface 170 of vacuum drum 150.(FIG. 4A). At this stage, likewise, insert 120 is shown moving, in the direction of arrow 250, toward the interior portion 130*n* of envelope 130. The insert 120 is shown with a leading edge 120L thereof headed toward the interior portion 130*n*.

Figure 4C:
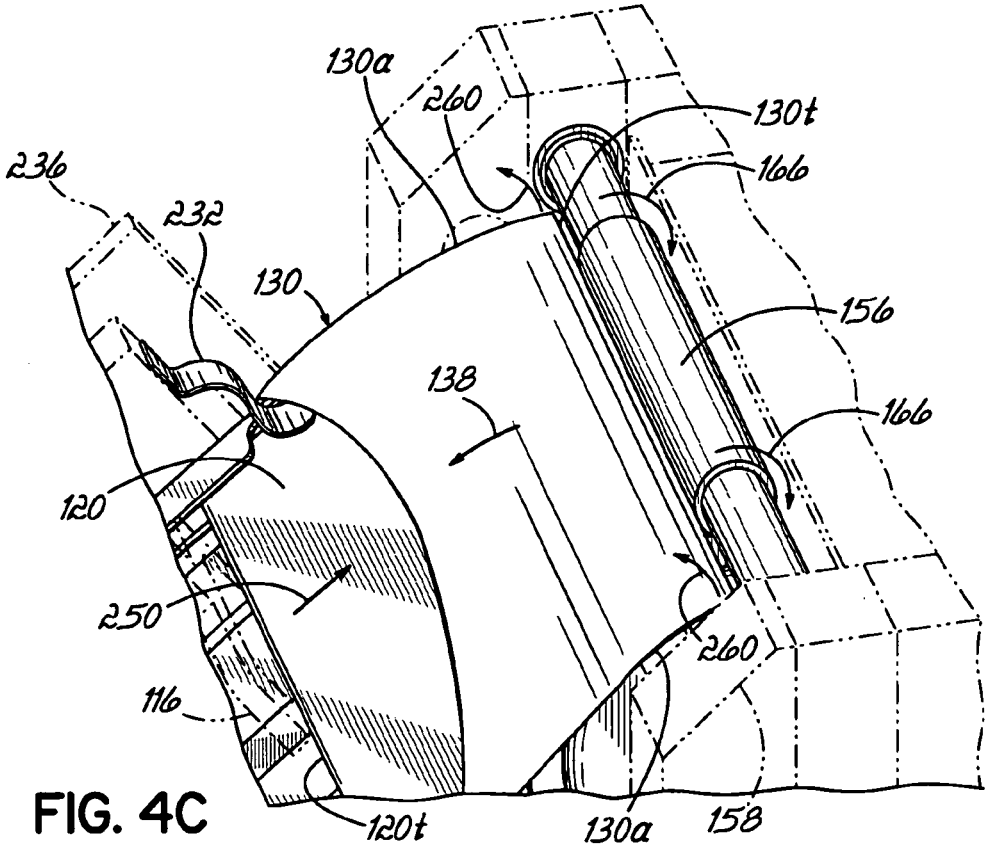
FIG. 4C is a view similar to FIGS. 4A-4B; showing the envelope thereof in yet a different position.
Figure 4D:
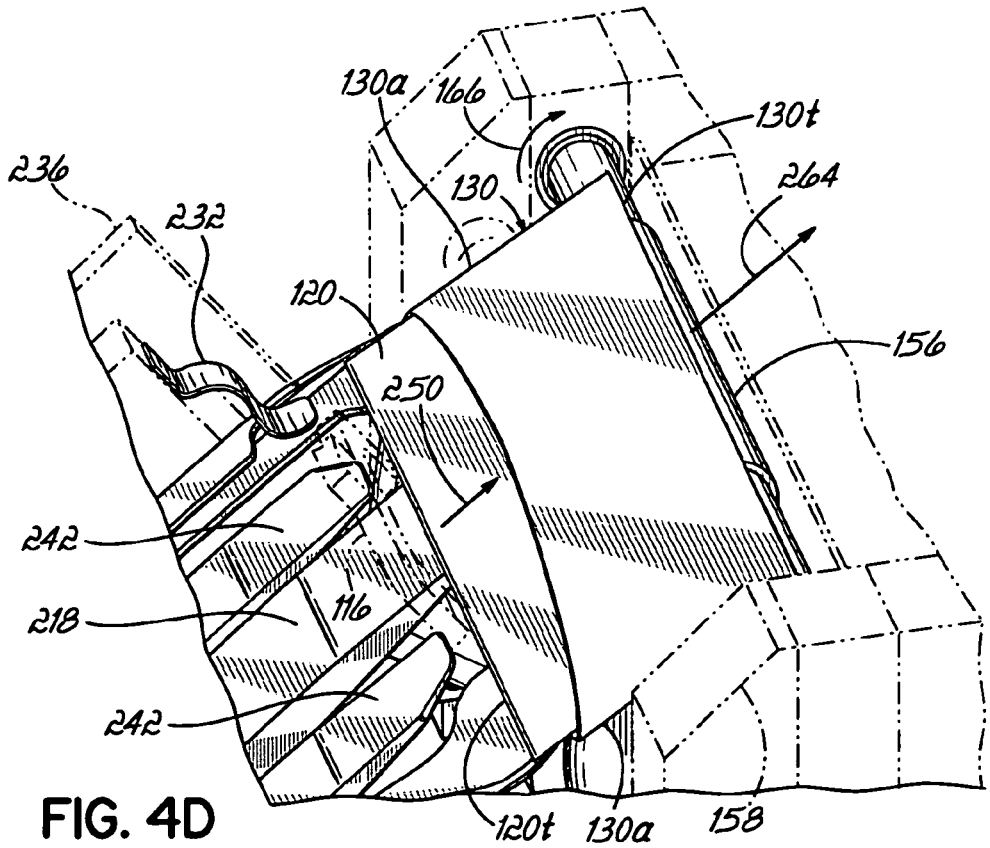
FIG. 4D is a view similar to FIGS. 4A-4C, showing the envelope thereof in yet a different position relative to FIGS. 4A-4C.

With particular reference to FIG. 4C, a stage of the inserting process is shown in which the envelope 130 is completely or at least mostly disengaged from the surface 170 of vacuum drum 150 (FIG. 4A). In this regard, rotation of vacuum drum 150 is such that envelope 130 slips relative to the rotational motion of vacuum drum 150. Clips 232 (only one shown) is depicted engaging envelope 130 so as to provide a stopping or limiting surface in the movement (arrow 138) of envelope 130 toward insert 120. Fingers 116 (shown in phantom) are depicted engaging a trailing edge 120*t* of insert 120 and thereby moving the insert 120 (arrow 250) toward the interior portion 130*n* of envelope 130. Clips 232, moreover, provide a lifting action for the envelope 130 such that, upon further movement of envelope 130 in the direction of arrow 138, a trailing edge 130*t* of envelope 130 is forced upward (arrows 260) and above the main roller 156, as shown in FIG. 4D. As used herein, the terms "upward," "upper," "lower," "above," "forward," "front," "back," and derivatives thereof are not intended as limiting but rather merely reflect the illustrative orientations shown in the figures.

With particular reference to FIG. 4D, a stage of the inserting process is shown in which forward movement of the fingers 116 (arrow 250) results in movement of the envelope in a similar direction (arrow 264) generally away from the transporting apparatus 220 at the insertion or stuffing station and toward the conveying assembly 90 (FIG. 1), for further disposition of the stuffed envelope 130. More specifically, at the stage of the process depicted in FIG. 4D, the leading edge 120L of insert 120 has reached the trailing edge 130*t* of envelope 130. Accordingly, forward movement of the fingers 116 exerts a force, through insert 120, upon trailing edge 130*t* of envelope 130, thereby resulting in movement of the stuffed envelope 130 in the direction of arrow 264.

Figure 5:
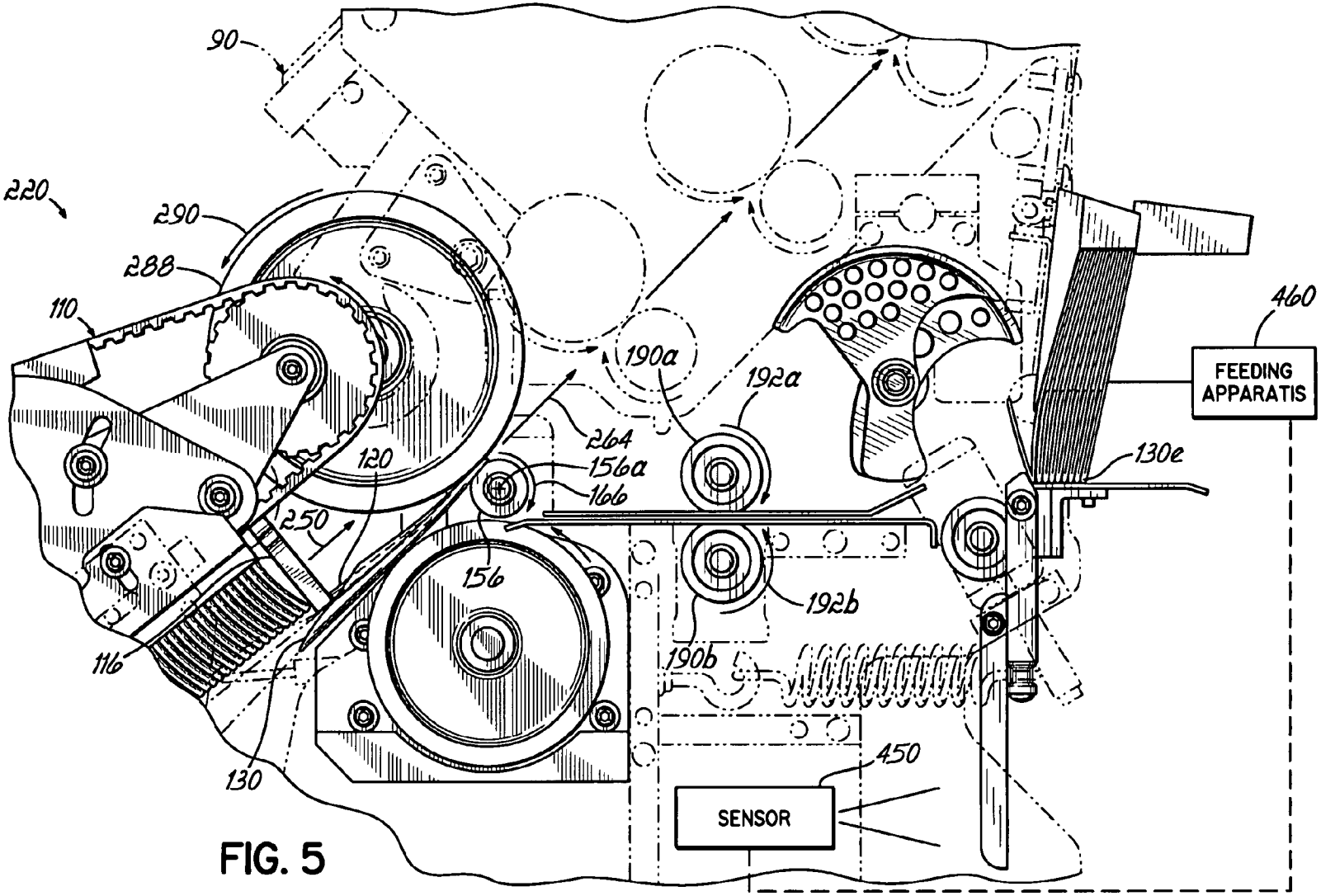
FIG. 5 is a view similar to FIG. 2 showing a stage of an inserting process.

With continued reference to FIG. 4D and with further reference to FIG. 5, rotation of the main roller 156 (arrow 166) cooperates to move the stuffed envelope 130 in the direction of arrow 264. More particularly, a rotating conveying roller 288 is disposed so as to define a small space between conveying roller 288 and main roller 156. Conveying roller 288 may alternatively be in the form of any other rotating element such as, for example, an irregularly-shaped rotating element and thus not limited to circular rotating element as depicted in this embodiment. Conveying roller 288 rotates in a direction (arrow 290) opposite that of main roller 156. The position of conveying roller 288 as well as its direction of rotation (arrow 290) relative to the direction of rotation (arrow 166) of main roller 156 permit nipping engagement of the stuffed envelope 130 and conveying thereof in the direction of arrow 264. In this particular embodiment, conveying roller 288 rotates in a counterclockwise direction, although this is not intended to be limiting but rather exemplary. Accordingly, rotation of the main roller 156 in the direction of arrow 166 enables movement of the envelope 130 in a first direction (arrow 138) during a stage of the inserting process while enabling movement of the envelope 130 in a second direction (arrow 250) opposite the first direction (arrow 138) and in an opposite side of an axis 156*a* of rotation of main roller 156 during a different stage of the process.

With reference to FIGS. 6-8, 8A, and 9, and as discussed above, the secondary rollers 190*a*, 190*b* engage a central portion of each envelope 130 to thereby move the envelopes 130 along the guides 180. In this regard, the envelopes 130 enter the guides 180 by action of a rotating pick-up element 320 that engages the leading portion 130*f*, of each of the envelopes 130. More particularly, pick-up element 320 is an irregularly shaped rotating structure having a central portion 322 and outer portions 324, both of which include respective circumferential surfaces 322*a*, 324*a* for engaging the envelopes 130.

The central portion 322 is circumferentially positioned in front of the outer portions 324, relative to the direction of rotation (arrow 352) thereof. Moreover, the central portion 322 of this exemplary embodiment is separately movable relative to the outer portions 324 such that the positions of these two portions 322, 324 of the pick-up element 320 can be adjusted relative to one another. Adjustment may be desirable, for example, to accommodate envelopes having different lengths 130L. Pick-up element 320 is positioned adjacent an envelope stack supporting apparatus to jointly define an envelope conveying apparatus 350, the details of which are discussed in further detail below.

Pick-up element 320 rotates, in this exemplary embodiment, and as noted above, in the direction of arrow 352. In this regard, and with particular reference to the stage of the process shown in FIG. 6, a leading portion, in this embodiment, in the form of a flap 131*f* of a first envelope 131 of a stack of envelopes 130 is shown prior to engagement thereof by pick-up element 320. Moreover, the first envelope 131 is shown oriented such that the flap 131*f* is hingedly movable generally in the direction of arrow 360.

Figure 7:
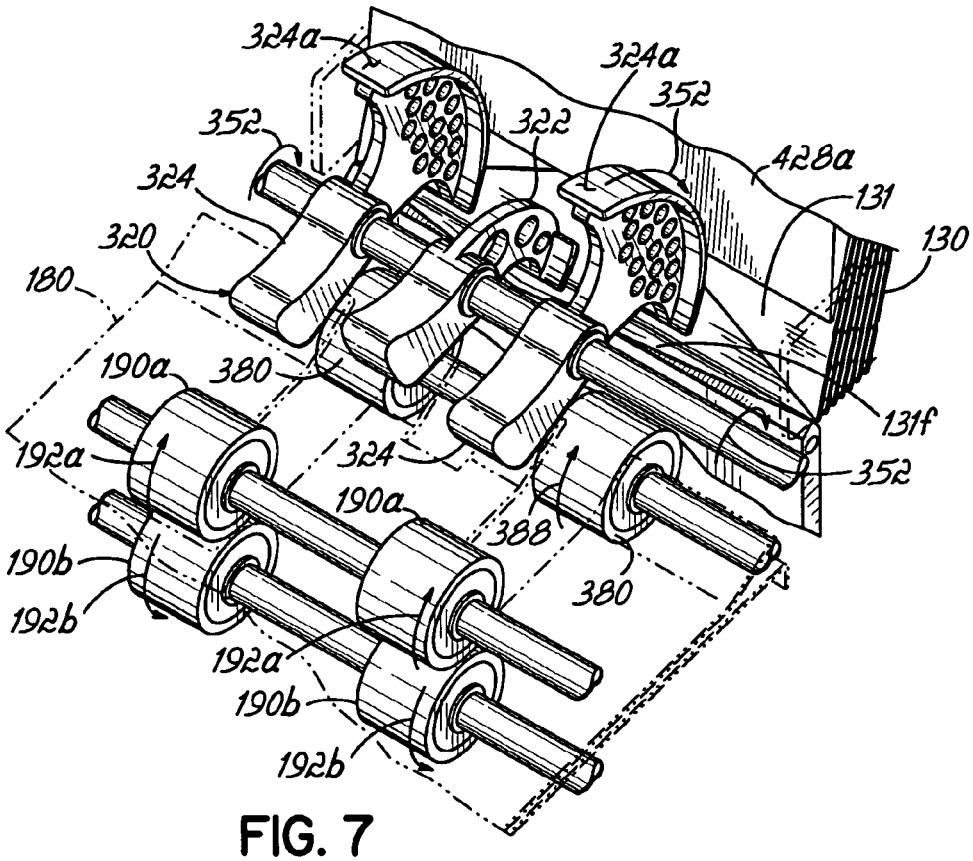
FIG. 7 is a perspective view of a portion of the envelope conveying apparatus of FIG. 6.

With particular reference to FIG. 7, the pick-up element 320 is shown having partially engaged envelope 131. More particularly, the central portion 322 of pick-up element 320 is shown having rotated sufficiently to engage the flap 131*f* of the first envelope 131, thereby causing flap 131*f* to hingedly rotate in the direction of arrow 360. Moreover, outer portions 324 are shown prior to engaging the first envelope 131.

Figure 8A:
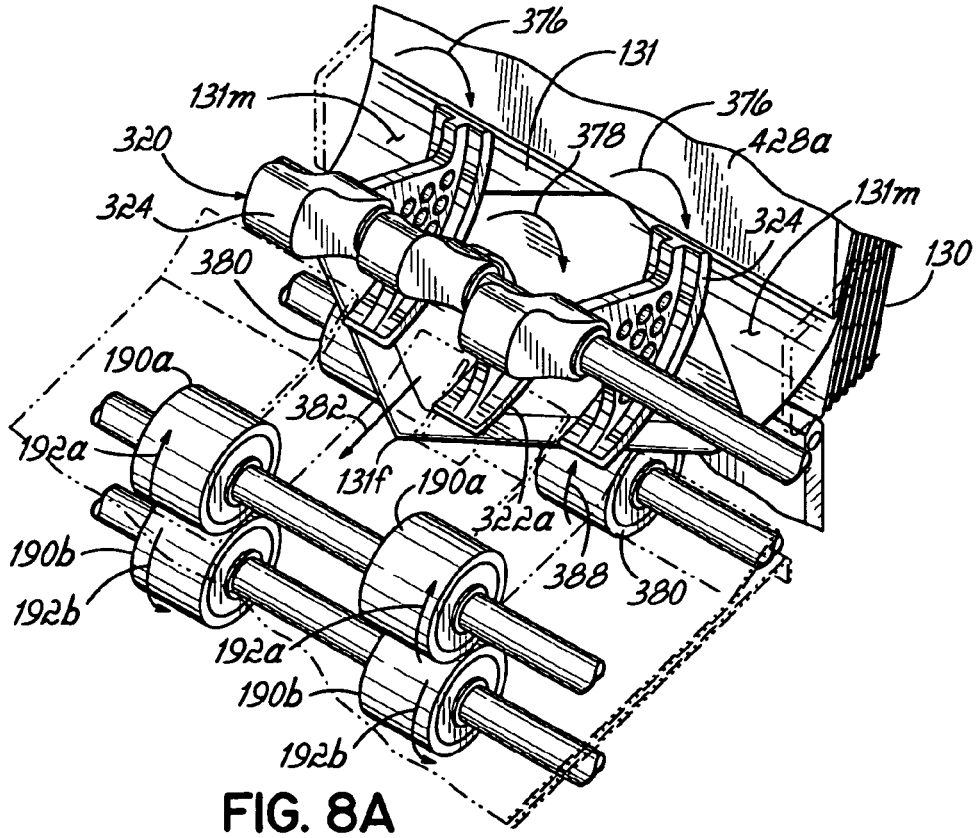
FIG. 8A is a view similar to FIG. 7 showing a portion of the envelope conveying apparatus at the stage illustrated in FIG. 8.
Figure 8:
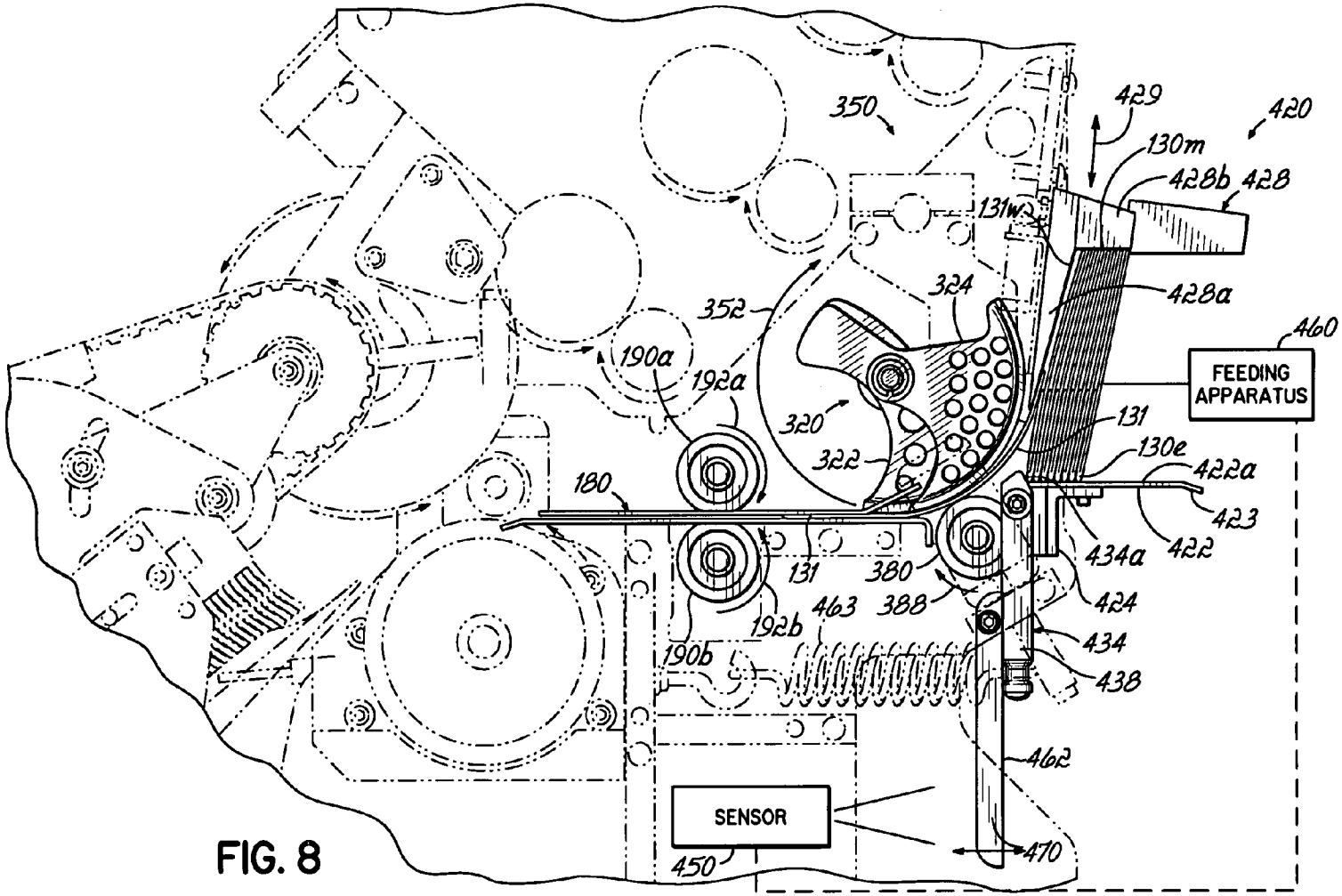
FIG. 8 is a view similar to FIG. 6, showing a stage in a process for conveying envelopes.

With particular reference to FIGS. 8-8A, pick-up element 320 is shown having rotated (arrows 376, 378) further in the direction of arrow 352 such that the central portion 322 and the outer portions 324 have engaged the flap 131*f* of the first envelope 131. In this regard, rotation of the outer portions 324 results in engagement of outer portions 324 with a set of follower rollers 380 made, for example and without limitation, of rubber or urethane. The position of the follower rollers 380 relative to outer portions 324 is such that they jointly nip the flap 131*f*, causing rotation of follower rollers 380 (arrow 388) and forward movement of the envelope 131 in the direction of arrow 382. FIGS. 8-8A also show partial engagement, by pick-up element 320, of discrete portions 131*m* of envelope 131. Engagement of discrete portions 131*m* other than flap 131*f* facilitate a smooth conveyance of envelope 131 toward the guides 180.

Figure 9:
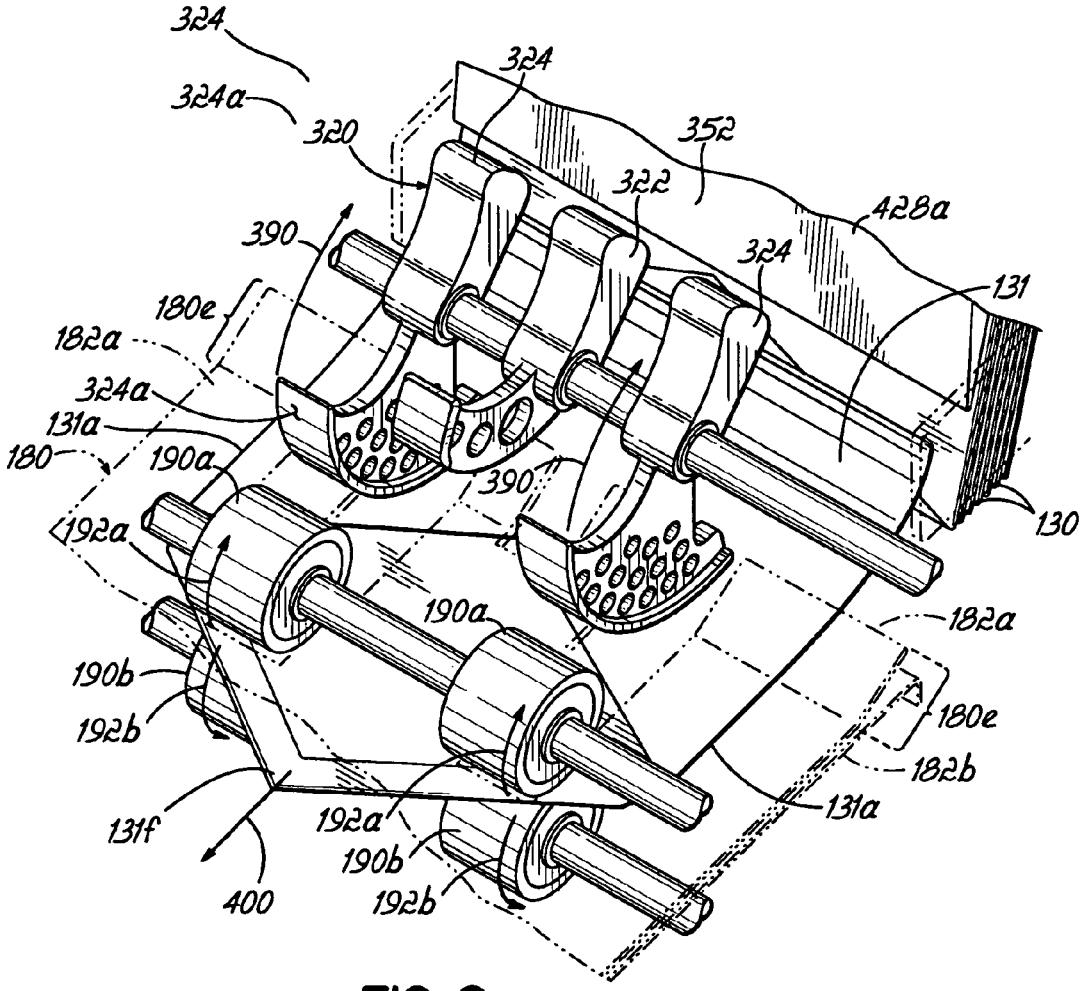
FIG. 9 is a view similar to FIGS. 7 and 8A, showing a different stage in the processing for conveying envelopes.

With particular reference to FIG. 9, pick-up element 320 is shown having rotated (arrows 390) further relative to the view of FIGS. 8-8A. The envelope 131 is shown in a position such that the lateral portions 131*a* thereof have entered guides 180 (shown in phantom). In this regard, the rails 182*a*, 182*b* of guides 180 are angled relative to one another in an entry portion 180*e* of guides 180 to facilitate movement of the lateral portions 131*a* into the space defined between rails 182*a*, 182*b*. In the shown view, moreover, central portion 322 of pick-up element is no longer in engagement with envelope 131, while outer portions 324 are rotating away from envelope 131 and thereby disengaging from envelope 131. Although not shown, as pick-up element 320 continues to rotate (arrows 390), it engages a new first envelope 131 from the stack of envelopes 130.

Referring again to FIG. 6, pick-up element 320 removes the first envelope 131 from a stack of envelopes supported by an envelope conveying system 420 that feeds envelopes 130 in a continuous fashion. Envelope conveying system 420 includes a support plate 422 mounted on and stationary relative to a frame structure 424. Support plate includes a generally flat surface 422*a* that is adapted to support a generally horizontal stack of the envelopes 130, each in a generally upright orientation. Moreover, in this exemplary embodiment, support plate 422 includes a ramp 423 to facilitate receiving envelopes 130. As used herein, the terms "upright" and "generally horizontal" are not intended to be respectively restricted to perfectly vertical or horizontal orientations of the envelopes 130 or the stack thereof, but rather an orientation whereby they are supported edgewise. In this regard, therefore, and as shown in FIG. 6, the envelopes 130 are supported edgewise (along lower edges 130*e*) in a generally upright orientation though defining an acute angle relative to the support plate surface 422*a*.

A stop member 428 of the envelope conveying system 420 is similarly supported from the frame structure 424 and is mounted in a fixed orientation relative to the support plate 422. Stop member 428 includes a forward portion 428*a* that supports a front or forward facing face 131*w* of the first envelope 131 of the stack of envelopes 130. A top portion 428*b* of the stop member 428 supports upper edges 130*u* of the envelopes 130. In this regard, the stop member 428 is vertically adjustable (arrow 429) to accommodate envelopes 130 of different pitches or lengths 130L. A schematically-depicted motor 430 is operatively coupled to stop member 428 to facilitate automatic adjustment of the vertical position of stop member 428 in response to length 130L. For example, and without limitation, motor 430 may be a stepper motor model HRA08C available from Sick Stegmann GmbH, a member of the Sick AG Group of Waldkirch, Germany. Jointly, the stop member 428 and the support plate 422 support the envelopes 130 in the generally upright orientation shown in FIG. 6.

Figure 6:
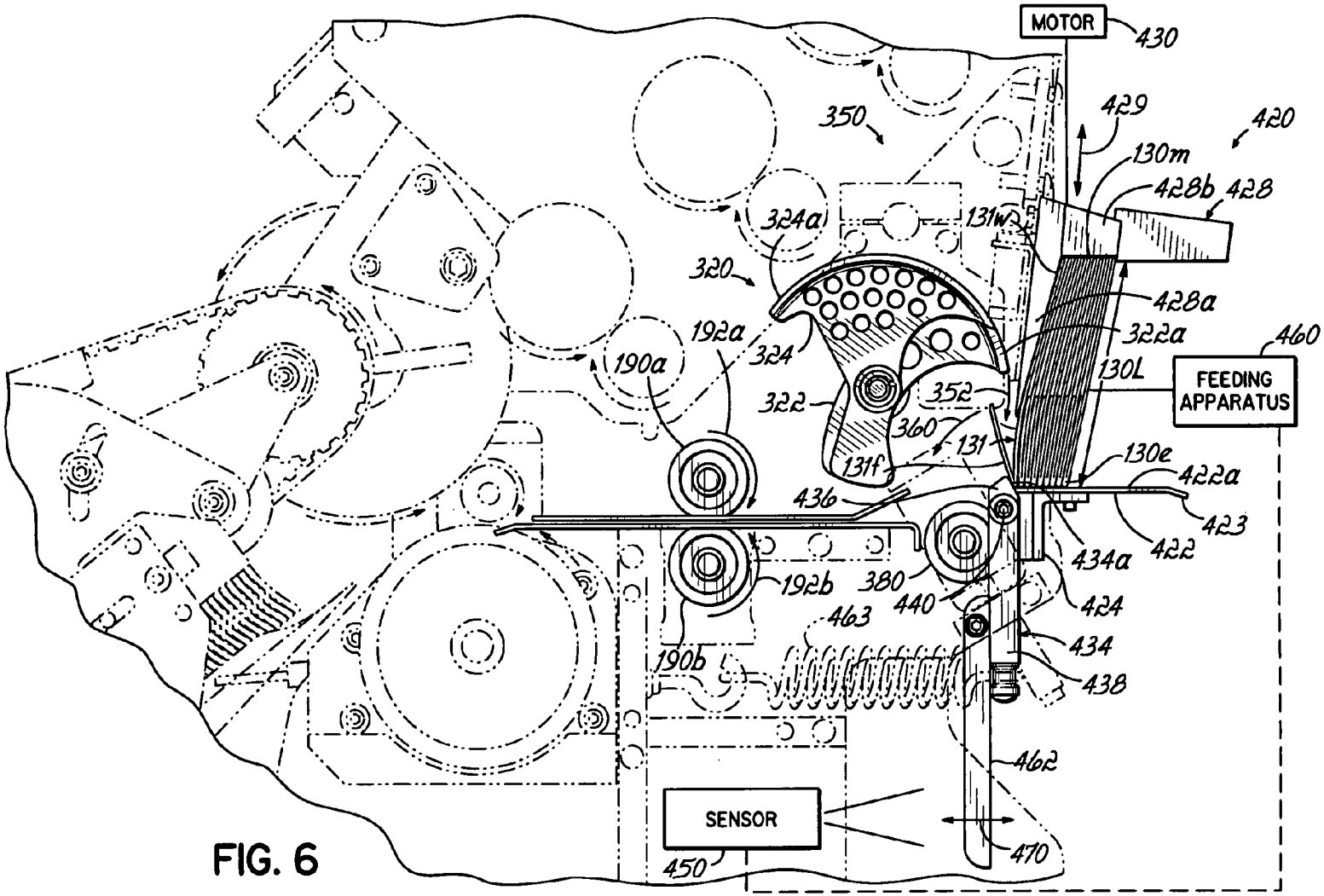
FIG. 6 is a view similar to FIGS. 2 and 5, showing a portion of an envelope conveying apparatus.

With continued reference to FIG. 6, a pressure sensing lever 434 of the envelope conveying system 420 is oriented generally transversely to the support plate 422 and is pivotally movable about a pivot 440 fixedly coupled to the frame structure 424. Pressure sensing lever 434 includes a sensing surface 434*a* that engages the first envelope 131 of the stack of envelopes 130. Pressure sensing lever 434 has a first portion 436 that includes the sensing surface 434*a* and extending from the pivot 440. A second portion 438 of the pressure sensing lever 434 also extends from the pivot 440 and away from the first portion 436. In this embodiment, the first portion 436 is shorter than the second portion 438. In operation, the first envelope 131 is in a feed position and oriented such that the flap 131*f* of the first envelope 131 extends into a region downstream of (i.e., behind) the sensing surface 434*a*.

A schematically-depicted sensor 450 is operatively coupled to, or in a position to sense, the second portion 438 for controlling a feeding apparatus 460 of the envelope conveying system 420. Feeding apparatus 460 exerts a feed force upon the stack of envelopes 120 that biases the stack toward the envelope feed position shown in FIG. 6. The sensor 450 is in this embodiment an infrared-type sensor, positioned to aim at an extension 462 coupled to the second portion 438 of pressure sensing lever 434 and configured to detect movement of the extension 462. In this exemplary embodiment, extension 462 is coupled to the frame structure 424 through a spring and hook assembly 463 (shown in phantom) to guide movement of extension 462 along the directions of arrow 470, and with a predetermined spring bias to hold the pressure sensing lever 434 against the first (i.e., lead) envelope 131. In this regard, movement of the extension 462 (arrow 470) results from a corresponding movement of the first portion 436 of pressure sensing lever 434 and which is caused by a feed force exerted by the stack of envelopes 130 against sensing surface 434*a*.

More specifically, the force exerted by the stack of envelopes 130 upon sensing surface 434*a* results from a feed or bias force applied against the stack by the feeding apparatus 460. This feed or bias force, in turn, determines the amount of pressure acting on the first envelope 131 held between the other envelopes 130 of the stack and the forward portion 428*a* of stop member 428. The pressure acting on the first envelope 131, in turn, determines the force necessary to remove the first envelope 131 from the stack of envelopes 130.

In this embodiment, the feeding apparatus 460 is operatively coupled to the sensor 450. In this regard, when sensor 450 detects movement of the extension 462 (arrow 470), sensor 450 sends a corresponding signal to feeding apparatus 460. In response to this signal, feeding apparatus 460 decreases or increases the amount of feed force it applies against the stack of envelopes 130 and thus, the pressure acting on the pressure sensing lever 434 and stop member 428. Accordingly, the feeding apparatus 460 is capable of controlling the pressure acting upon the first envelope 131 of the stack of envelopes 130 to thus maintain it at a predetermined desired level to facilitate removal of the first envelope 131 from the stack. For example, and without limitation, the feeding apparatus may, during operation, feed the envelopes 130 with a first feed force and a corresponding pressure exerted against the forward portion 428*a* of stop member 428. This first force results in pivotal movement of the pressure sensing lever 434. The sensor 450 detects the movement of extension 462 associated with the first force. Sensor 450, in turn, sends a corresponding signal to the feeding apparatus 460 which, in response to the signal, adjusts the feed force with which it feeds the envelopes 130, for example to a lower, second feed force. This lower second force results in a lower pressure exerted against forward portion 428*a* of stop member 428 which, in turn, results in a smaller deflection of pressure sensing lever 434.

While the present invention has been illustrated by a description of various embodiments and while these embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of the general inventive concept.

What is claimed is:

1. An apparatus for inserting a paper or film object or a stack of such objects into an envelope, comprising:

a feeding apparatus for moving the object toward the envelope;

a rotatable vacuum drum having a surface adapted to engage and move the envelope toward the object; and a ramp element coupled to said vacuum drum and stationary relative thereto, said ramp element including a generally flat surface tangential to said vacuum drum and adapted to support the envelope as the envelope moves with said vacuum drum.

2. The apparatus of claim 1, wherein said vacuum drum is servo-controlled and includes a plurality of holes defining a surface for engagement of the envelope, and a vacuum source in fluid communication with said plurality of holes for selectively applying negative pressure through one or more of said plurality of holes.

3. The apparatus of claim 1, wherein said vacuum drum includes a vacuum source continuously generating negative pressure at the surface of said vacuum drum.

4. The apparatus of claim 1, further comprising:

a first rotatable element rotatable in a first rotating direction for moving the envelope in a first travel direction toward the object.

5. The apparatus of claim 4, wherein said first rotatable element is rotatable in said first rotating direction to move the envelope in a second travel direction opposite the first travel direction.

6. The apparatus of claim 5, further comprising:

a second rotating element cooperating with said first rotating element to move the envelope in the second travel direction.

7. The apparatus of claim 4, wherein said first rotatable element is configured to contact the envelope on first and second sides of an axis of rotation of said first rotatable element for respectively moving the envelope in the first and second travel directions.

8. The apparatus of claim 5, wherein said feeding apparatus includes a plurality of fingers, each of said plurality of fingers cooperating with said first rotating element to move the envelope in the second travel direction.

9. The apparatus of claim 8, wherein each of said plurality of fingers moves the object against a trailing end of the envelope to thereby move the envelope in the second travel direction.

10. The apparatus of claim 1, wherein rotation of said vacuum drum relative to said ramp element is configured to lift the envelope away from said surface of said vacuum drum.

11. The apparatus of claim 1, further comprising:

at least one clip for limiting movement of the envelope toward the object.

12. The apparatus of claim 11, further comprising:

a motor operatively coupled to said at least one clip for automatically adjusting a position of said clip in response to a length of the envelope.

13. An apparatus for inserting a paper or film object or a stack of such objects into an envelope, comprising:

a feeding apparatus for moving the object toward the envelope;

a rotatable vacuum drum having a surface adapted to engage and move the envelope toward the object and a vacuum source continuously generating a negative pressure at said surface;

a ramp element coupled to said vacuum drum and stationary relative thereto, said ramp element including a generally flat surface tangential to said vacuum drum adapted to support the envelope as the envelope moves with said vacuum drum.

14. An automatic envelope stuffing apparatus having a first end associated with feeding of a roll of paper and a processing apparatus for converting the roll of paper into discrete sheets, the envelope stuffing apparatus further comprising:

an apparatus for inserting the discrete sheets of paper into envelopes, said apparatus including:

(a) a feeding apparatus for inserting the discrete sheets of paper toward the envelopes;

(b) a rotatable vacuum drum having a surface adapted to engage and move the envelopes toward the discrete sheets; and (c) a ramp element coupled to said vacuum drum and stationary relative thereto, said ramp element including a generally flat surface tangential to said vacuum drum and adapted to support the envelopes as the envelopes move with said vacuum drum.

15. The apparatus of claim 14, wherein said vacuum drum is servo-controlled and includes a plurality of holes defining the surface for engagement of the envelopes, and a vacuum source in fluid communication with said plurality of holes for selectively applying negative pressure through one or more of said plurality of holes.

16. The apparatus of claim 14, wherein said vacuum drum includes a vacuum source continuously generating negative pressure at the surface of said vacuum drum.

17. A method of inserting a paper or film object or a stack of such objects into an envelope, comprising:

moving the object toward an insertion station;

applying negative pressure against the envelope to engage the envelope against a rotating surface of a drum;

moving the rotating surface of the drum to move the envelope toward the insertion station; and supporting a leading portion of the envelope with a relatively stationary surface as the envelope moves with the rotating surface of the drum.

18. The method of claim 17, further comprising:

lifting the leading portion of the envelope away from the rotating surface.

19. The method of claim 17, further comprising:

rotating a first rotating element in a first rotating direction to move the envelope in a first travel direction toward the object.

20. The method of claim 19, further comprising:

rotating the first rotating element in the first rotating direction to move the envelope in a second travel direction opposite the first travel direction.

21. The method of claim 17, further comprising:

continuously applying the negative pressure against the rotating surface.

22. The method of claim 17, further comprising:

electrically controlling movement of the rotating surface, relative to a vacuum source for selectively generating the negative pressure on selected portions of the rotating surface.

23. The method of claim 17, further comprising:

moving the envelope in a plane generally tangential to the rotating surface.

24. An apparatus for processing envelopes and a paper or film object or a stack of such objects to be inserted into the envelopes, comprising:

a frame structure;

a support plate mounted on said frame structure and generally stationary relative thereto, said support plate having a generally flat surface for supporting a stack of the envelopes in a generally upright orientation;

a pressure sensing lever mounted on said frame structure and having a sensing surface oriented transverse to said support plate, said pressure sensing lever being pivotally movable in response to pressure exerted by the stack of the envelopes, said pressure sensing lever positioned relative to said support plate to permit a leading portion of a first envelope of the stack to extend into a region behind said sensing surface;

a feeding apparatus for moving the object toward an envelope of the stack of envelopes;

a rotatable vacuum drum supported from said frame structure and having a surface adapted to engage and move the envelope toward the object; and a ramp element coupled to said vacuum drum and stationary relative thereto, said ramp element including a generally flat surface tangential to said vacuum drum adapted to support the envelope as the envelope moves with said vacuum drum.

25. A method of processing envelopes and a paper or film object or a stack of such objects to be inserted into the envelopes, the method comprising:

moving the object toward an insertion station;

applying negative pressure against the envelope to engage the envelope against a rotating surface of a drum;

moving the rotating surface of the drum to move the envelope toward the insertion station;

supporting a leading portion of the envelope with a relatively stationary surface as the envelope moves with the rotating surface of the drum;

applying a first force against a stack of the envelopes to move them toward the insertion station;

engaging a first envelope of the stack with a pivotally movable surface;

pivotally moving the movable surface in response to the first force; and applying a second force against the stack of envelopes different from the first force.

26. A method of processing envelopes and a paper or film object or a stack of such objects to be inserted into the envelopes, the method comprising:

moving the object toward an insertion station;

applying negative pressure against the envelope to engage the envelope against a rotating surface of a drum;

moving the rotating surface of the drum to move the envelope toward the insertion station;

supporting a leading portion of the envelope with a relatively stationary surface as the envelope moves with the rotating surface of the drum;

biasing a stack of the envelopes toward an envelope feed position;

sensing pressure on a lead envelope at the feed position resulting from the biasing; and controlling the biasing in response to the sensing.

27. The method of claim 26, further comprising:

removing the lead envelope from the stack of envelopes; and moving the lead envelope toward the insertion station.

* * * * *